United States Patent [19]

Marcella

[11] 4,243,228

[45] Jan. 6, 1981

[54] REMOTELY-PERCEPTIBLE IMPACT-INDICATING PROJECTILE TARGET

[76] Inventor: Joseph Marcella, c/o P.O. Box 18948 Dockweiler Station, Los Angeles, Calif. 90007

[21] Appl. No.: 949,393

[22] Filed: Oct. 6, 1978

[51] Int. Cl.[3] ..... F41J 5/00

[52] U.S. Cl. ..... 273/378; 273/363; 273/365

[58] Field of Search ..... 273/102 AF, 102 B, 102.1 C, 273/105.4, 105.5, 363, 378, 380

[56] References Cited

U.S. PATENT DOCUMENTS

| | | | |
|---|---|---|---|
| 250,101 | 11/1881 | Powell | 273/105.5 |
| 957,742 | 5/1910 | Chiantore | 273/105.4 |
| 975,711 | 11/1910 | Newbold | 273/105.4 |
| 1,369,830 | 3/1921 | Mitchell | 273/105.4 |
| 1,636,645 | 7/1927 | Noda | 273/102 AF |
| 1,723,826 | 8/1929 | Van Auken | 273/102 AF |
| 3,326,363 | 6/1967 | Bennett et al. | 220/23 |
| 3,796,813 | 3/1974 | Kurland | 206/217 |

FOREIGN PATENT DOCUMENTS

| | | | |
|---|---|---|---|
| 84333 | 12/1895 | Fed. Rep. of Germany | 273/105.4 |
| 7857 | of 1894 | United Kingdom | 273/105.4 |
| 622226 | 7/1946 | United Kingdom | 273/102 B |

*Primary Examiner*—Anton O. Oechsle

[57] ABSTRACT

A remotely-perceptible, impact-indicating target for a projectile, such as a bullet or the like, constructed so as to remotely perceptibly indicate, to a target shooter at a projectile shooting location, the impact of a shot or fired projectile or bullet on a remotely located target in a manner clearly visibly perceptibly indicating not only the hit, but the impact location of the projectile or bullet on the target, by causing the effective expansion in an explosion-simulating manner of a quantity of visibly perceptible target material.

2 Claims, 10 Drawing Figures

38
30
20
22
40
28
34
24
3
26
32
36
42
4

REMOTELY-PERCEPTIBLE IMPACT-INDICATING PROJECTILE TARGET

BACKGROUND OF THE INVENTION

The field of the invention is generally that of targets intended for use in testing one's skill in shooting some type of projectile, more particularly, for use in target shooting with a gun which fires one or more bullets at a target for the purpose of testing one's accuracy or the correctness of the sighting adjustment of the gun.

There are a great many prior art targets intended for the above-mentioned general purposes. However, when it comes to portable targets—targets that can be carried to some convenient location in the country or some other remote safe target shooting location, the customary target has serious disadvantages arising primarily from the fact that if one is positioned at a substantial distance from such a conventional prior art target of the bull's eye type, or any other similar prior art target, it is difficult to tell exactly where one's bullet has hit the target after shooting or firing at it. In many instances, it will be necessary to walk up to the target for the purpose of closely examining it to determine precisely where one's previously fired bullet has hit the target. This is disadvantageous for a number of reasons, among them being the inconvenience of having to walk up to the target frequently in order to carefully examine it for the bullet impact location determination mentioned above, plus the fact that there is some danger in frequently approaching the target if there are several target shooters positioned at one or more remote shooting locations. There is always the possibility of someone else shooting at the target while a first person is near the target which, of course, is extremely dangerous.

One prior art effort to overcome the above-mentioned prior art problem has been the use of various telescopic or binocular type optical devices, such as regular telescopes, binoculars, spotting scopes, or the like, so that one can view the target very carefully from the target shooting location for the purpose of attempting to determine precisely where the previously fired bullet has impacted the target. However, such spotting scopes are relatively expensive and are frequently not available to casual target shooters or frustrated hunters who have been unable to find their intended game and end up doing a little target shooting in the field. Under such field target shooting conditions, frequently, the target shooters will set up a row of cans or bottles rather than to use conventional bull's eye-type paperboard or cardboard targets primarily because of the previously mentioned prior art problem of knowing where one's bullet has hit such a conventional bull's eye-marked paper target. This is, of course, not true when one target shoots at bottles, cans, or the like, where the impact of the fired bullet will be immediately perceptible to the target shooter either because the hit bottle explodes or the hit can is caused to fly from its previous at rest location or emits a loud sound when it is shot by a bullet, or because it in some way produces a visible indication to the target shooter that he has hit the intended target, or, conversely, has missed it. That is the primary reason why such casual field target shooters frequently shoot at bottles, cans, electric power wire insulators and other objects which will give off a visible indication when hit by a fired bullet.

However, all of the above-mentioned types of targets are disadvantageous for various reasons, including the fact that broken bottles and torn up cans are a hazard or a danger to the next person who walks in that vicinity and create ecological problems. The use of telephone pole or power pole insulators as casual field targets is even more disadvantageous because the shooting of same by a bullet, and the resulting consequent damage caused to same, may bring about serious telephone or power line problems which may require expensive repair and maintenance.

Quite obviously, it would be highly advantageous to provide some type of readily portable target which would be convenient for casual field target shooting use, or any target shooting use for that matter, and which would provide a very perceptible indication to a remote target shooter of the hitting or missing of the target by a fired bullet and which would be relatively inexpensive and ecologically safe and non-damaging to the environment. It is precisely such a highly desirable and advantageous type of remotely-perceptible impact-indicating projectile target that is provided by and in the present invention, which target has advantages virtually completely overcoming the above-mentioned prior art problems, disadvantages and limitations, and all of which advantages flow from and occur by reason of the specific features of the invention pointed out hereinafter.

SUMMARY OF THE INVENTION

Generally speaking, the remotely-perceptible, impact-indicating target of the present invention comprises at least one target element (often a plurality of target elements) with each such target element comprising a compact closely-assembled quantity of impact-expansible target material responsive to projectile impact in an outwardly expansible, explosion-simulating extremely visibly perceptible manner, and further including target element mounting means for mounting at least one of said target elements, often a plurality of said target elements, with each such target element being so mounted as to facilitate the positioning thereof at any desired effective target range location at any desired degree of remoteness from a person intending to shoot one or more projectiles, such as bullets fired from a firearm, at said element (or plurality of target elements.)

In one form of the invention, each such target element may comprise a closely-compacted assembly of target material of a visibly perceptible color capable of being easily remotely visibly observed by a target shooter from a target shooting location when a projectile impacts any portion of said assembly of target material and causes same to effectively expand in an explosion-simulating manner outwardly from the point of impact of a shot projectile or fired bullet thereon.

In one preferred form, the visibly perceptible color of the target material is provided by the inclusion therein, in a substantially evenly disseminated manner therethrough, of a desired visibly perceptible color additive. In one preferred form, the closely-compacted assembly of target material comprises such an assembly of finely-divided particles of color additive material, although the liquid color additive material may also be employed for imparting desired color to the finely-divided particles of solid target material in certain forms of the invention.

In a preferred form, the finely-divided particles of solid target material may comprise particulate material of a low-density powdered type, such as Fuller's earth, diatomaceous earth, or substantial equivalent, while a preferred form of the color additive material may comprise a non-toxic dry coloring dye material of the food coloring type, although not specifically so limited in all forms of the invention.

In one preferred form, the closely-compacted assembly of finely-divided particles of solid target material may be of initially effectively unitary, molded, impact-fragmentable construction. In a preferred form of the invention, the target element mounting means comprises target-material-containing means which may take the form of a target-material-containing thin sheet means and a target base sheet positioned adjacent to the thin sheet means and with a plurality of effective pockets being defined therebetween, each adapted to carry one of said target elements therein. In one preferred form, the thin sheet means may be made of a thin sheet of plastic material having a plurality of the target element mounting pockets formed therein, while the target base sheet may be of a paper or cellulosic material fastened immediately behind the front-positioned pocket-containing thin plastic sheet.

In one preferred form, the target-material-containing means may be so positioned and may carry a plurality of target elements correspondingly positioned so as to comprise a target array, with each target element mounting means carrying a different target element in a different portion of said target array for providing a plurality of desired frontally-positioned mult-target-element locations supplying desired target-shooting variety, desired different target-shooting difficulties and, consequently, different target-hitting scores.

In certain forms of the invention, the target element, and the target material thereof, may be of a non-solid consistency capable of the previously mentioned effective expansion, as a result of bullet impact, in a remotely visibly perceptible manner.

Also, it should be noted that, in certain forms of the invention, a lesser number of target elements may be provided for more convenient use in certain locations and may be capable of being rested upon an auxiliary support, leaned against an auxiliary support or hung from an auxiliary support and, in certain cases, may be adapted to be movably mounted by being carried by a movable mounting device, if desired.

In a preferred form, the various materials of the target are made of non-ecologically damaging, non-environmentally-damaging material, preferably of a biodegradable type.

OBJECTS OF THE INVENTION

With the above points in mind, it is an object of the present invention to provide a novel remotely-perceptible, impact-indicating projectile target capable of ready portability and usage at virtually any desired target shooting location, even at a casual or temporary site, and which will provide a remote visual indication to a target shooter of the effectiveness of his target shooting performance by clearly showing projectile-impact upon one or more target elements.

It is a further object of the present invention, to provide a novel target of the character referred to herein, generically and specifically, and which may include any or all of the features referred to herein, either individually or in combination, and which is of extremely easy-to-manufacture, easy-to-package, easy-to-ship, and easy-to-use construction and which is capable of being manufactured in a variety of sizes, shapes, styles, costs, price ranges, etc.,—all at relatively low cost both as to the initial capital cost (including production set-up costs, tooling cost, etc.) and as to the subsequent per-unit manufacturing cost, whereby to be conducive to widespread production, distribution, sale, and use of the novel target of the present invention for the purposes outlined herein or for any other substantially functionally equivalent purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinafter-described figures of the accompanying two sheets of drawings and are described in detail hereinafter.

DESCRIPTION OF THE PREFERRED EMBODIMENTS

Figures 1, 2, 3, 4, 5:
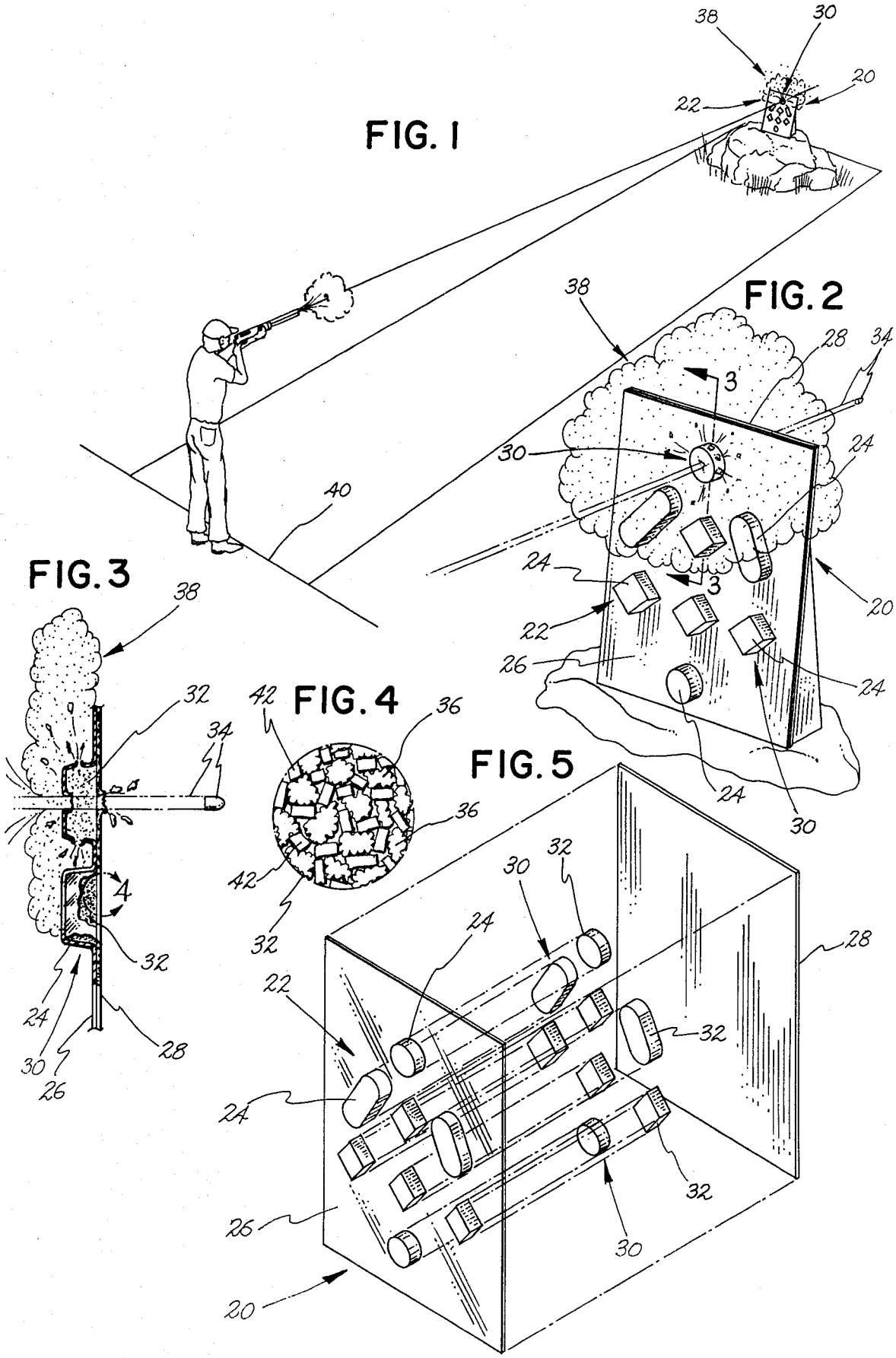
FIG. 1 is a greatly-reduced size, three-dimensional, pictorial, oblique, perspective view illustrating one embodiment of the invention wherein the remotely-perceptible, impact-indicating target is positioned at a location remote from a shooting position (indicated somewhat diagrammatically and schematically) so as to effectively comprise what might be termed a shooting range or a target range for one or more persons positioned at the shooting location and intending to shoot one or more projectiles from any suitable projectile-shooting device toward the impact-indicating target. In this view, one target element of the multiple-target-element complete target is shown shortly after it has been shot by a projectile shot by a person positioned at the shooting location and illustrates the fact that the struck target element has effectively expanded in what might be termed an explosion-simulating manner which is extremely visibly perceptible to the shooter, or any other remotely located person, usually positioned at the shooting location.
FIG. 2 is in a larger-scale perspective view of the complete composite multiple-target-element target of FIG. 1 which better shows the details thereof because of the substantially larger scale of this view.
FIG. 3 is a fragmentary sectional view taken substantially along the plane and in the direction indicated by the arrows 3—3 of FIG. 2 and clearly illustrates, in a representative manner, the construction of the complete composite target of FIGS. 1 and 2 and, in a representative way, shows one exemplary form of construction of each of the plurality of individual target elements of which the composite target of FIGS. 1 and 2 is comprised. Furthermore, this view clearly illustrates in a lower cross-section representative one of said target elements prior to being impacted and effectively exploded by a projectile and also shows another upper one of said target elements immediately after being impacted and effectively exploded by a projectile and thus clearly illustrates the response of the target element to such impact by a projectile.
FIG. 4 is a greatly-enlarged, somewhat symbolic cross-sectional view of a portion of the target material of the various target elements, such as the representative unexploded lower one thereof shown in FIG. 3, and is intended to clearly illustrate in a simplified, somewhat diagrammatic and schematic manner, the particulate nature of the closely compacted assembly of target material and the interspersing or dissemination therethrough of a particulate color additive material, with each of these being shown in representative simulated particle configurations which are of a representational nature only, and are not intended to show the actual physical structure of the target material if an enlarged cross-section thereof were photographed under magnification.
FIG. 5 illustrates one step in one representative mode of manufacture of one representative form of the invention, comprising the use of a vacuum-formed target-material-containing thin sheet means or member which can then receive effectively unitary, molded quantities of the target material therein and can then have an effective base sheet or packing sheet affixed in opposition to the target-material-containing thin sheet whereby to effectively form what might be termed pockets, each carrying a molded unitary but impact-fragmentable quantity of the target material therein.

Generally speaking, the remotely-perceptible, impact-indicating target of the present invention comprises at least one target element (in many forms, a plurality of such target elements) comprising a compact, closely-assembled quantity of what might be termed impact-expansible target material which is responsive to projectile impact in an outwardly expansible and explosion-simulating, extremely visibly perceptible manner, creating a cloudburst effect, and which is further provided with target element mounting means for mounting at least one of said target elements, often a plurality of such target elements, for facilitating the positioning thereof at any desired target range location at any desired degree of remoteness from a person intending to shoot one or more projectiles at one or more such target elements.

In the specific exemplary first form of the invention illustrated in FIGS. 1-5 inclusive, a plurality of such target elements are mounted by a composite target-element-mounting means so as to comprise one complete composite target, such as is generally designated by the reference numeral 20. The plurality of target elements can be filled with differently colored target material, thus indicating, through the cloudburst effect, various areas struck by the bullet or projectile.

In the first exemplary form illustrated, the composite target-element-mounting means comprises a target-material-containing means which is illustrated as being of thin sheet form as designated at 22 and which has a series of pockets 24 molded in a single base sheet 26 whereby to comprise a complete unitary multi-pocket plastic sheet forming said target-material containing means 22. In the first example illustrated, said target-element-mounting means also include a target base sheet 28 adapted to be positioned relative to the target-material-containing thin sheet means 22 in opposition to the openings into the multiple pockets 24 defined therein whereby to effectively provide and define an arrangement where each of the multiple pockets 24 is effectively closed.

In the example illustrated, the target-material-containing thin sheet means 22 is illustrated as being of molded thin sheet plastic construction, preferably of a biodegradable type while the rear target base sheet 28 is illustrated as being of a thin sheet cellulosic material type. However, these are merely exemplary forms of construction and should not be construed in a specifically limiting manner.

In the exemplary first form of the invention, each target element is generally designated by the reference numeral 30 and in each case is shown as comprising a closely assembled quantity of impact-expansible target material 32 positioned within each of the pockets or containers 24. The target material 32 in each of the target elements is of a type responsive to projectile impact, such as is shown with respect to the upper target element 30 of FIG. 1, in what might be termed an outwardly expansible explosion-simulating extremely visibly perceptible manner as can best be understood from the careful examination of the upper target element 30 of FIGS. 1, 2 and 3. The impact of a projectile, such as the broken-line bullet shown at 34 in FIG. 3 after having struck and passed through the upper target element 30, will cause the fragmentation and effective explosion of at least certain of the multiple particles of finely divided solid target material (such as best shown at 36 in FIG. 4) which will then spread outwardly and form a small cloud, such as that shown at 38, which is readily visibly perceptible by a person standing at the shooting position, such as that indicated somewhat diagrammatically and schematically by the shooting position line 40 of FIG. 1.

As is best shown in the greatly enlarged fragmentary symbolic section comprising FIG. 4, each quantity of target material 32 of each target element 30 is shown as being made up of a closely-compacted and initially effectively unitary assembly of finely-divided particles of solid target material, representative ones of which are indicated at 36 in FIG. 4. The target material 32 (comprising the particles 36) is shown as being effectively unitary as a result of having been initially molded into the proper target element configuration for the reception by, and the mounting in, the corresponding pockets 24 of the target-element-mounting thin sheet means 22. The molding process is usually accompanied by the presence of any evaporable liquid, such as water, or any other desired liquid, which results in the target material particles 36 effectively adhering to each other to form a unitary assembly of same until such time as impacted by a projectile, such as the bullet 34 of FIG. 3 for example, although not specifically so limited. The impact of any such projectile will immediately break any adhesions between adjacent target material particles 36 which have existed prior to such impact, but will do so primarily in the impact area only, thus leaving the remainder of the unitary target element 30 substantially undamaged. However, the portion thereof which is impacted and effectively pulverized is caused to effectively expand or explode rapidly in an outward manner, which is permitted by reason of the fact that the corresponding portion of the thin sheet plastic pocket 24 will also have been either pulverized or blown away as a result of having been impacted by the bullet 34. Thus, the very visibly perceptible cloud of particles 38 will be caused to emanate from the particular target element 30 which has been impacted by the bullet 34 and this will be readily visible to remote observers and in particular to a person who has fired the bullet 34 from a gun. Thus, that person, and any other observers, will immediately know how accurate the shot has been and without the necessity of either walking up to the target to determine where the impact location is or without the necessity of using a remote spotting scope or binoculars for the same purpose.

The target material particles 36 may initially be of a visibly perceptible color capable of being easily remotely visibly observed by a target shooter from a target shooting location when a shot projectile impacts any portion of the target material 32, or such visibly perceptible color may be imparted to the target material 32 by including therein (usually in a manner substantially evenly disseminated therethrough) a desired visibly perceptible color additive, which may be of a dried particulate type similar to the target material particles 36, as indicated at 42 in FIG. 4. For example, a completely non-toxic type of particulate coloring which is available in a wide variety of colors comprises food coloring or food dyes, and this type of coloring is very convenient for use as the color additive. However, various other color additives and even color additives of a non-solid type may be employed in certain forms of the invention, if desired.

The exemplary first form of the invention illustrated in FIGS. 1 through 4, inclusive, and described above may be made in any of several different ways, but one exemplary mode of manufacture would be to vacuum-form a thin sheet of plastic material of a biodegradable type, such as is indicated at 22, which would be formed in a manner such as to effectively produce a series of thin sheet plastic pockets 24, all integral with and comprising a part of the complete plastic thin sheet means 22, which comprises the previously-mentioned and generically referred to target-material-containing means which, of course, is also designated by said reference numeral 22. A target base sheet, which in the example illustrated is of a flat configuration, although not specifically so limited in all forms of the invention, may be made of cellulosic material such as paper, cardboard, chipboard, or a relatively stiff cardboard type backing material covered with a target-printed paper face in certain forms of the invention. All of these are to be construed as being within the scope of the disclosure of the rear target base sheet 28 illustrated in the first form of the invention.

As previously mentioned, the target material 32 of each target element 30 is preferably initially formed into a closely-compacted and initially effectively unitary assembly of finely-divided particles 36 of the solid target material. This may be done by initially molding the particles 36 of the target material into target elements of a size and shape suitable for reception by the corresponding thin sheet plastic pockets 24 of the complete composite thin sheet plastic target-material containing means 22, after which the molded closely-compacted assembly of the finely-divided particles 36 of each molded quantity of target material 32 forming each target element 30 is moved into the interior of a corresponding one of the plastic pockets 24 and the target base sheet 28 is moved into rear juxtaposition with the rear surface of the flat portions of the composite plastic thin sheet means 22 and is appropriately fastened thereto, such as by being adhesively or cohesively fastened thereto by cement, adhesive, or otherwise, or by being mechanically fastened thereto such as by staples or the like. This will result in the exemplary composite multi-element target shown in small scale perspective in FIG. 1 and illustrated in various different manners in FIGS. 2–4 inclusive and shown in an initial, pre-assembly, exploded view in FIG. 5.

It should, of course be noted that in the molding process mentioned above as exemplary of one mode of manufacturing of the first form of the invention illustrated in FIGS. 1–5 inclusive, visibly perceptible color additive means or material may be suitably intermixed with the target material, 32 as is shown in one greatly enlarged over-simplified and somewhat diagrammatic form at 42 in FIG. 4. However, it should be understood that the color additive material may be in liquid form and may be intermixed with the target material 32 as an alternative to the particulate type of color additive material shown at 42 in FIG. 4. Furthermore, it should be additionally understood that, if desired, the target material particles 36 may be of a type which initially has a very visibly perceptible character, such as an inherent color or an artificially added color, so that the separate dye addition step or color additive intermixing step may be modified or eliminated in certain forms of the invention.

It should be noted that, in the exemplary first form of the invention, the various different target elements 30 may be either arranged at varying distances from a target center so that if one aims at the target center, impacting target elements at greater or lesser distances therefrom indicates a lesser or greater target shooting accuracy, in which case, the various differently located target elements may be differently colored or otherwise differently visibly perceptible upon impact, so that a remote shooter will be able to readily tell from his shooting location where he has impacted the target, and his accuracy or inaccuracy in doing so, by the different appearance or different color of the visible cloud 38 of effectively exploded target material emanating from the point of impact of the projectile.

Figure 6:
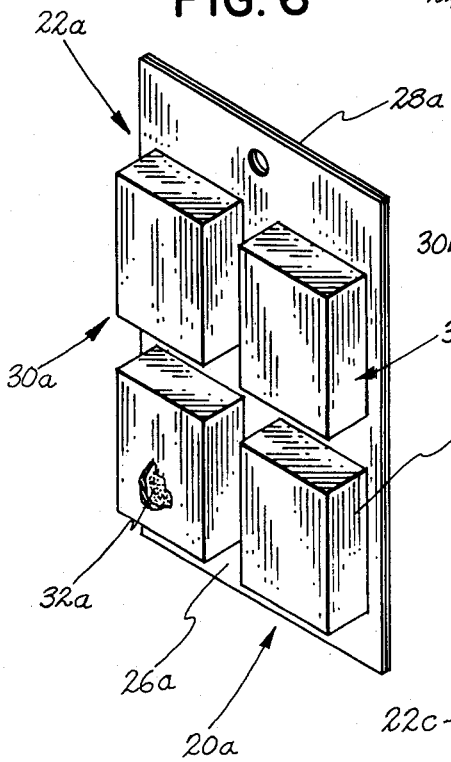
FIG. 6 is a view illustrating a slight modification wherein a complete target carrying a smaller number of the target elements is provided.

FIG. 6 illustrates a slight modification wherein each composite target is of a considerably smaller size and carries a considerably smaller number of the target elements than the structure shown in the first form of the invention. Therefore, corresponding parts are designated by similar reference numerals followed by the letter "a". In the example illustrated in FIG. 6, the composite target 20*a* carries a much smaller number of the individual complete target elements 30*a* than the first form of the invention. This is provided by the fact that the target-material-containing means 22*a* carries a smaller number (4, in the example illustrated) of the pockets 24*a* molded into the front plastic sheet 26*a*. In the example illustrated, the frontal appearance of the plastic sheet 26*a* and the target base sheet 28*a* positioned immediately behind the front plastic sheet 26*a* is generally rectangular in appearance and there are only four target elements 30*a* carried thereby. This much smaller composite target 20*a* lends itself to various target uses where the lesser expense and the simpler mounting of such a smaller composite target 20*a* may be more convenient and advantageous, particularly for target-shooting use in the field or at locations other than at a regular target range. The construction of each individual target element is generally similar to that of the first form of the invention and therefore, no further detailed description thereof is thought to be necessary or desirable.

Figure 7:
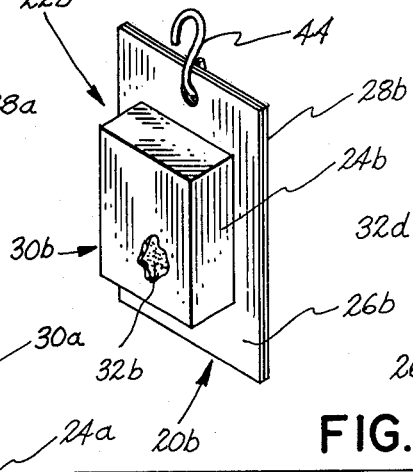
FIG. 7 illustrates a further slight modification wherein each complete target comprises an individual target element by itself.

FIG. 7 illustrates a slight variation of the invention, wherein individual targets are provided and are adapted to be either stood up in place by resting them against some auxiliary support, or may be hung from some overhead auxiliary support by the provision of a small mounting hook 44 at the top thereof. Parts of this modification which correspond to the earlier forms of the invention are designated by similar reference numerals, followed by the letter "b" and, apart from the individual nature of each target element 30*b*, the construction thereof is substantially identical to earlier described forms of the invention and therefore, no additional and repetitive description thereof is thought to be necessary or desirable.

Figure 8:
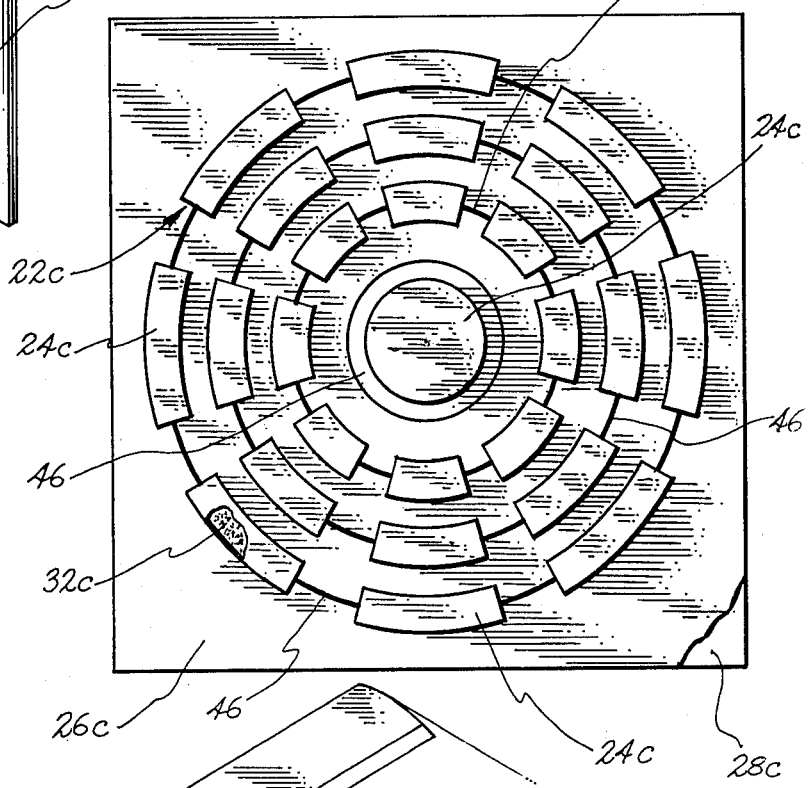
FIG. 8 illustrates a further slight modification wherein the target of the present invention simulates the appearance of a conventional bull's eye-type target wherein corresponding different portions effectively represent corresponding different target-shooting and target-hitting difficulties and, if desired, corresponding different shooting scores.

FIG. 8 illustrates a further slight modification of the invention wherein the composite target simulates the appearance of a conventional target and has a plurality of the target-shooting variety, desired target-shooting difficulties and consequently, desired target-hitting scores. In this modification, parts which correspond to previously described forms of the invention are designated by similar reference numerals followed by the letter "c." The target base sheet 28*c* may be pre-printed, with conventional bull's eye target markings, 46 or such markings may be carried by the plastic sheet 26*c* positioned in front of the target base sheet 28*c* so that a shooter viewing the target from a remote shooting location will see the conventional bull's eye type target markings 46, which correspond to different degrees of target shooting difficulty and are in accordance with conventional practice. However, the various target elements 30*c* are located at different distances from the center of the target at locations along, adjacent to, or corresponding to the different bull's eye type target markings 46 and each may have its individual target material 32*c* differently colored so that when a person shoots at the center of the bull's eye markings 46, his accuracy or inaccuracy will be readily apparent from his shooting location by merely observing both the position and color of the cloud of particles which will emanate from the impacted location, each of which will be similar to the representative small cloud of particles 38 shown in FIG. 1. If desired, various different score values may be assigned to the different target rings of the target markings 46 and correspondingly to the differently-located target elements 30*c*.

Figure 9:
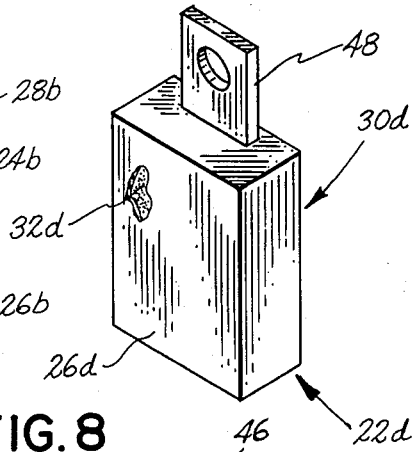
FIG. 9 is an arrangement wherein each target element is effectively mounted by a target element mounting means of slightly modified construction.

FIG. 9 is an illustration of one exemplary slightly modified target element, wherein the target element is designated by the reference numeral 30*d* and wherein the molded target material 32*d* has an inner fabric core piece or strip 48 which not only mounts the target element so that can be attached to a target base sheet by a staple or the like, or in any other convenient manner, but also provides a means for holding the particles of the target material 32*b* together, so that only an impacted portion will be effectively exploded by the impact of a projectile, while the remainder of the target material 32*d* will still remain in closely-assembled compacted form. This slight modification may have a plastic front sheet 26*d*, forming a pocket 24*d*, and a base sheet similar to that shown at 28*b* in FIG. 7 or, in certain forms, one or the other, or both, of these may be eliminated because of the effective fastening together of the particles of the target material 32*d* by the fabric core, strip or tape 48.

Figure 10:
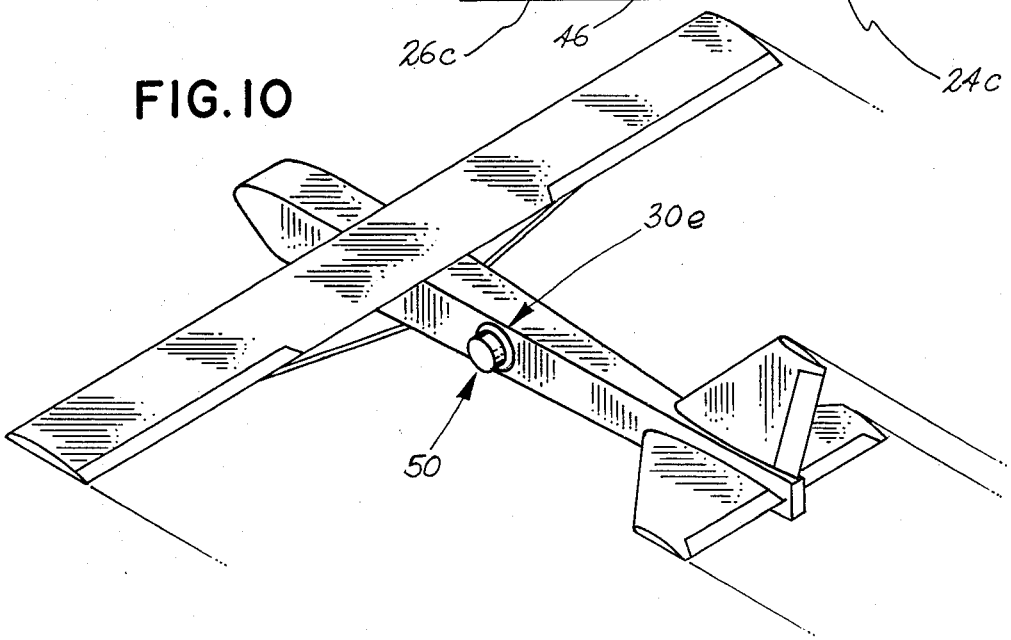
FIG. 10 is a view illustrating a further modification which is adapted to be attached to any movable supporting structure whereby to provide the interest and variety occasioned by a movable target.

FIG. 10 is a view illustrating a representative form of the invention, such as the individual target form shown in FIG. 7, or the fabric core form shown in FIG. 9, or any of the other forms of the invention, wherein the target element 30*e* is adapted to be attached to any movable supporting structure, such as the small simulated airplane or glider, indicated generally at 50 in FIG. 10, whereby to provide interest and variety in the form of a movable target, simulating some conventional target object, perhaps of a military target nature, such as an airplane, glider or the like. This latter form of the invention is merely illustrative of the movable target concept, and the particular vehicle or carrier providing for movement of the target element 30*e* may take a great many different forms within the broad scope of the invention. It should further be understood that the provision of the specifically indicated target element 30*e* in the manner illustrated in FIG. 10, wherein it is shown attached to the airplane or glider 50, is illustrative only and is not to be construed as limiting the invention to the attachment of such a specific target element to a movable carrier, such as the airplane or glider shown in FIG. 10. Actually, the particulate target material, such as shown at 32 in the first form of the invention and in enlarged, somewhat diagrammatic form, with each of the individual particles 36 being represented in FIG. 4, may be placed at any desired location within, on, or attached to any desired part of a movable carrier which, for representative purposes only is shown in FIG. 10 as comprising an airplane, glider, or the like. However, any other type of movable object may be employed in lieu thereof and the impact-expansible target material may be carried throughout or at any desired location by the movable carrier. For example, it might merely be placed inside the fuselage and/or wings, and/or tail section and/or nose section of the glider or plane 50 shown in FIG. 10 or similarly may be positioned at any desired location within or on any other desired type of movable carrier. In other words, the attachment of a specific particular target element to a specific particular exterior part of a movable carrier in the manner shown in FIG. 10 is not required in all forms of the invention and is not to be construed as a specific limitation, but rather to be merely exemplary of the broad movable target concept of this aspect of the invention.

It should be understood that the figures and the specific description thereof set forth in this application are for the purpose of illustrating the present invention and are not to be construed as limiting the present invention to the precise and detailed specific structures shown in the figures and specifically described hereinbefore. Rather, the real invention is intended to include substantially equivalent constructions embodying the basic teachings and inventive concept of the present invention.

What is claimed is:

1. A remotely-perceptible impact-indicating target for a projectile adapted to remotely-perceptibly indicate at a projectile-shooting location the impact of a shot projectile on a remotely located target in a manner clearly visibly perceptibly indicating the impact location of the projectile against the target, comprising: at least one target element comprising a compact closely-assembled quantity of low density impact-expansible target material responsive to projectile impact in an outwardly expansible explosion-simulating extremely visibly perceptible manner creating a cloudburst effect, whereby said shot projectile impacting any portion of said assembly of target material causes only that portion to effectively expand in an explosion simulating manner outwardly from the point of impact of said shot projectile thereon without substantially affecting the composition of adjacent said portions; and target element mounting means for mounting at least one of said target elements for facilitating the positioning thereof at any desired target range location at any desired degree of remoteness from a person intending to shoot one or more projectiles at said target element, wherein a plurality of said target elements are included and are carried by said target element mounting means in a selected target array and wherein said target element mounting means comprises target-material-containing thin sheet means containing a quantity of said target material in a plurality of selected locations and is further provided with a target base sheet positioned relative to said target-material containing thin sheet means in a manner such as to enclose and confine a desired quantity of said target material therebetween in said plurality of target element locations in said selected target array, said base sheet being cooperable with a target-supporting auxiliary structure.

2. A remotely-perceptible impact-indicating projectile target as defined in claim 1, wherein said base sheet cooperates with and effectively carries the plurality of said target-material-containing means in a plurality of desired frontally-positioned, multi-target-element locations for providing desired target shooting variety, desired target-shooting difficulties and desired target-hitting scores.

* * * * *